US005979943A

United States Patent [19]

Moreira et al.

[11] Patent Number: 5,979,943

[45] Date of Patent: Nov. 9, 1999

[54] SHEARABLE COMPLETION RISER JOINT

[75] Inventors: José Roberto Ferreira Moreira; Orlando José Soares Ribeiro, both of Rio de Janeiro, Brazil

[73] Assignee: Petroleo Brasileiro S.A. - Petrobras, Rio de Janeiro, Brazil

[21] Appl. No.: 08/111,922

[22] Filed: Aug. 26, 1993

[30] Foreign Application Priority Data

Aug. 27, 1992 [BR] Brazil ..... 9203362

[51] Int. Cl.[6] ..... F16L 35/00

[52] U.S. Cl. ..... 285/3; 285/39; 166/55; 166/298; 166/361

[58] Field of Search ..... 285/18, 3, 39, 285/2, 1; 166/350, 354, 359, 381, 297, 298, 299, 361, 55.7, 98, 55

[56] References Cited

U.S. PATENT DOCUMENTS 4,181,196 1/1980 Darby et al. ..... 166/381
4,332,509 6/1982 Reynard et al. ..... 166/350 X
4,703,802 11/1987 Bryan et al. ..... 166/298
5,044,826 9/1991 Forster ..... 166/350 X
5,400,857 3/1995 Whitby ..... 166/298

*Primary Examiner*—Dave W. Arola
*Attorney, Agent, or Firm*—Sughrue, Mion, Zinn, Macpeak & Seas, PLLC

[57] ABSTRACT

The present invention refers to a completion riser joint (1) shearing by the shear ram of the blow-out preventer (BOP) (2), to be coupled, at its lower part, to the column hoist running tool and, at its upper part, to the completion riser column, the referred shearing completion riser joint (1) comprising upperly a riser bolt (3), connected at its lower portion to an access pipe (4) to the production column, shearing by the shear ram of the BOP (2), enveloped by hydraulic lines (5, 6) that allow the actuating of the column hoist running tool and the access to the annular, the referred pipe (4) being connected lowerly to a re-entry mandrel (8), which function is to allow the locking of the recovery tool (12) and, through it, allow the hydraulic continuity for actuating the unlocking function of the piping hoist and, following, its release, and lowerly to a riser box (9) on top of the piping hoist running tool.

3 Claims, 6 Drawing Sheets

SHEARABLE COMPLETION RISER JOINT

The present invention refers to a shearing completion riser joint by the shear ram of the blow-out preventer (BOP), to be coupled, at its lower part, to the column hoist running tool and, at its upper part, to the completion riser column, also making part of this specification a conception of tool to allow the release of removal of the column hoist running tool, after the cutting of the referred shearing joint by the ram of the blow-out preventer (BOP).

In case of position loss of completion dynamic positioning rig (ship or semi-submersible), or in adverse sea conditions, it is necessary to disconnect, in less than 30 seconds, from the Lower Marine Riser Package (LMRP) of the blow-out preventer (BOP). This disconection, in a standard emergency procedure, is automatically preceeded by closing of the shear ram of the blow-out preventer (BOP), which should be capable of cutting the column is by chance in front of it, to allow the safe abandonment of the well.

During the completion phase, the most critical operation is the seating of the column hoist, when we will have a completion riser joint in front of the shear ram. There is no garantee of cutting of the completion riser joint by the shear ram since, by norm (API 16A), the shear ram should cut drill pipes of 19,5 lb/ft, grade "E" or "G", making no demands as to cutting of pipeline with larger diameters or weights.

SUMMARY OF THE INVENTION

According to the present invention, a completion riser joint shearing by the shear ram of the blow-out preventer (BOP) is provided, to be coupled, in its upper lower part, to the column hoist running tool and, in its upper part, to the completion riser column, the referred shearing completion riser joint comprising upperly a riser bolt, conected at its lower portion to an access pipe to the production column, shearing by the shear ram of the blow-out preventer (BOP), enveloped by hydraulic lines that allow the actuating of the column hoist running tool and the access to the annular, the referred pipe being connected lowerly to a re-entry mandrel, which function is to allow the locking of the tool of recovery and, through it, allow the hydraulic continuity for the actuating of unlocking function of the piping hoist and, next, its release, and lowerly a riser box on top of the piping hoist running tool.

Still according to the present invention it is provided a tool conception to allow the release to removal the piping hoist running tool, after the cutting of the referred shearing joint by the ram of the blow-out preventer (BOP), the upper part of the referred tool comprising a jacket which use is to allow the jacketing of the sheared pipe and, consequently, the access of re-entry mandrel connector, the referred jacket having tears to allow its cutting by the blow-out preventer (BOP) in the case of position loss during fishing, and the lower part comprising a hydraulic connector which locks in the re-entry mandrel and allows the access to the line of unlock of the column hoist running tool and its later removal.

BRIEF DESCRIPTION OF THE DRAWINGS

The invention will now be decribed, in more detail, together with the drawings that follow the present specification, in which.

DESCRIPTION OF A PREFERRED EMBODIMENT

Figure 1A:
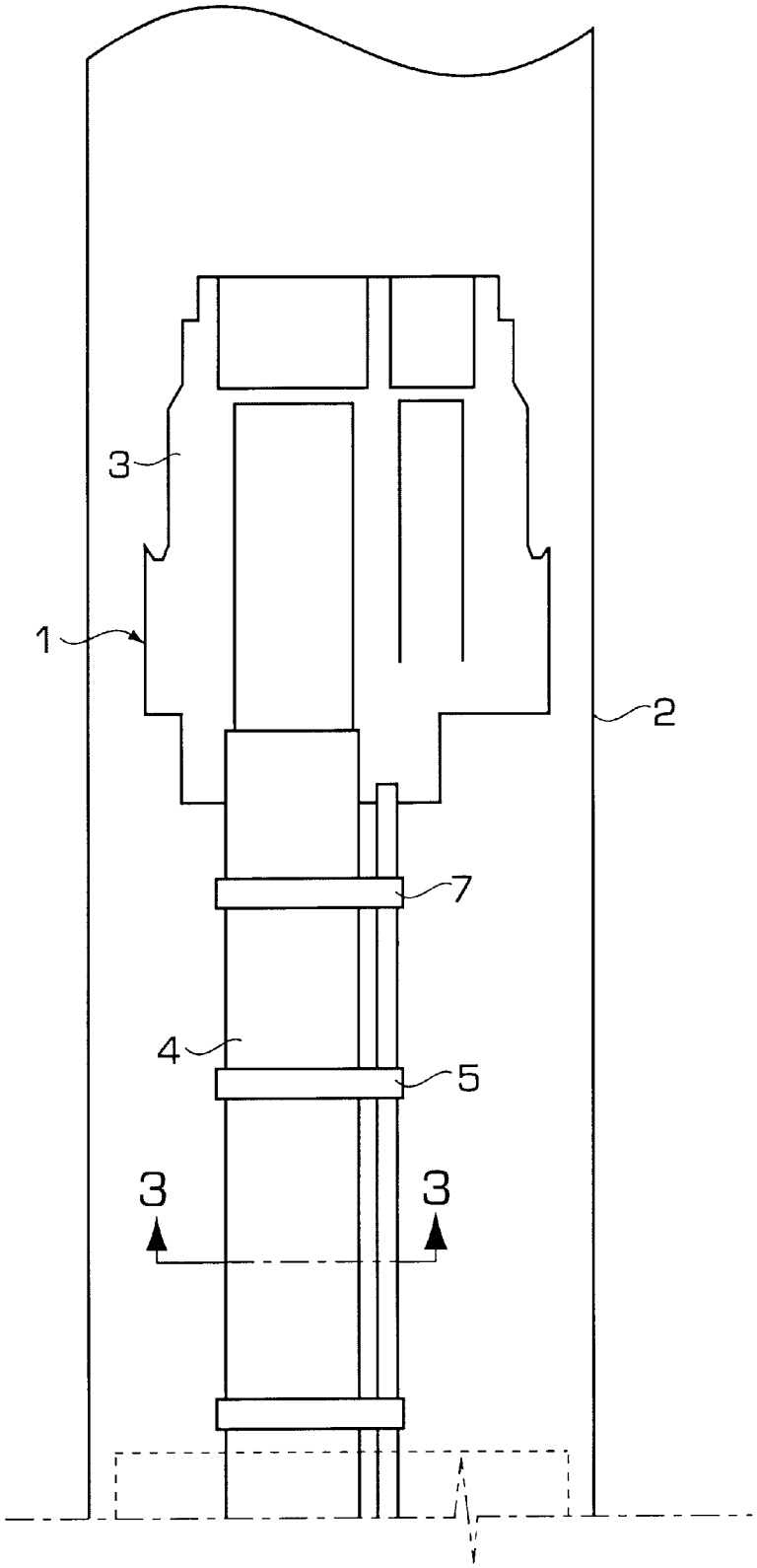
FIGS. 1A and 1B are sections representing the shearing completion riser joint, according to the present invention, positioned inside a blow-out preventer (BOP)
Figure 1B:
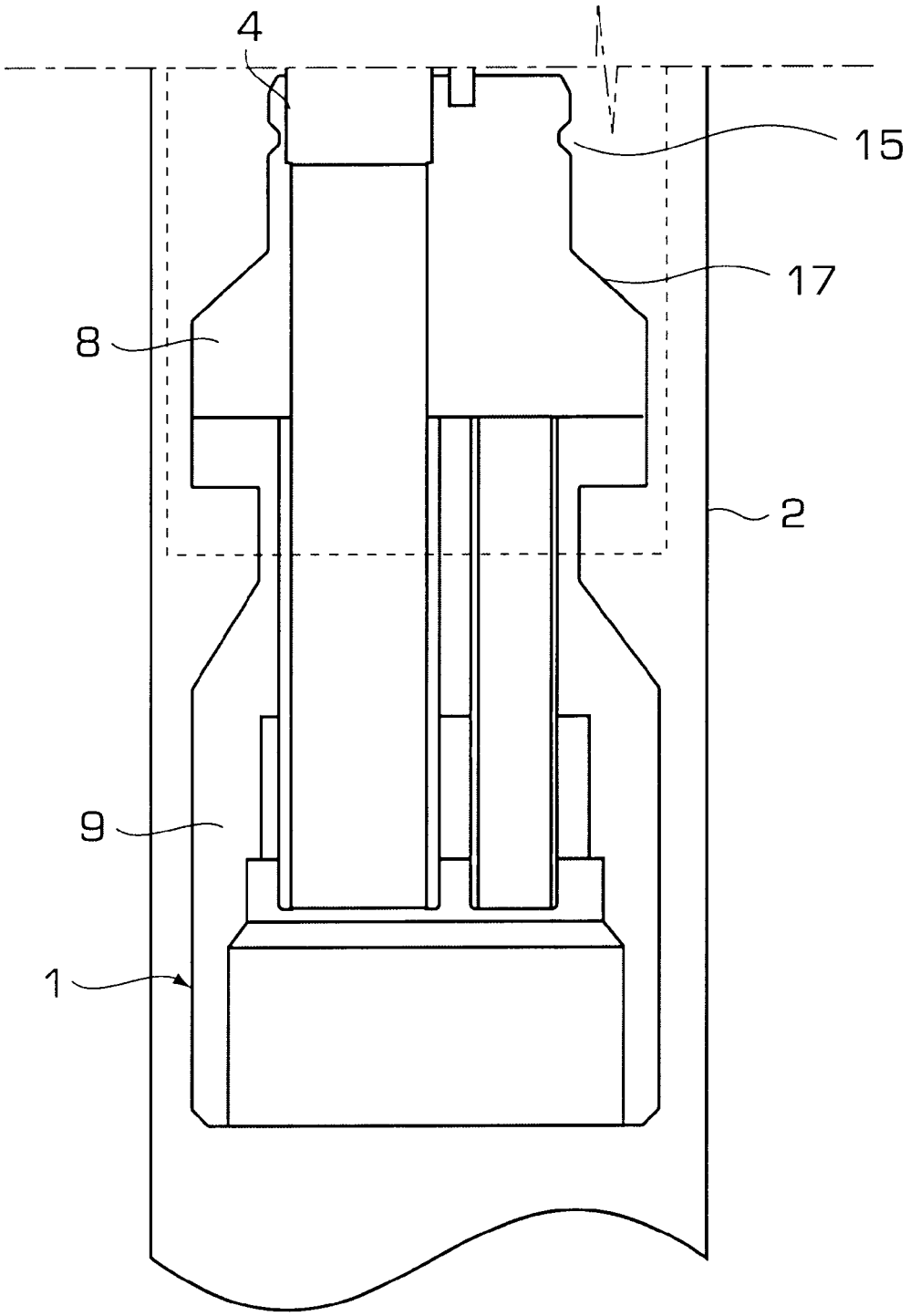

As it can be gathered from FIGS. 1A, 1B, 3 and 5, the completion riser joint (1) shearing by the shear ram of the blow-out preventer (BOP) (2), to be coupled, at its lower part, to the column hoist running tool and, at its upper part, to the completion riser column, comprises upperly a riser bolt (3), connected at its lower portion to an access pipe (4) to the production column, shearing by shear ram of the blow-out preventer (BOP) (2), containing, in its interior, hydraulic lines (5) with ½ in (0,0127 m), hydraulic lines (6) with ⅜ in (0,0095 m) and with external protector (7) which allow the actuating of the column hoist running tool and the access to the annular, referred pipe (4) being connected lowerly to a re-entry mandrel (8), which function is to allow the locking of the recovery tool and, through it, allow the hydraulic continuity for actuating the unlocking function of the piping hoist and, following, its release, and lowerly a riser box (9) on top of the piping hoist running tool.

Figure 5:
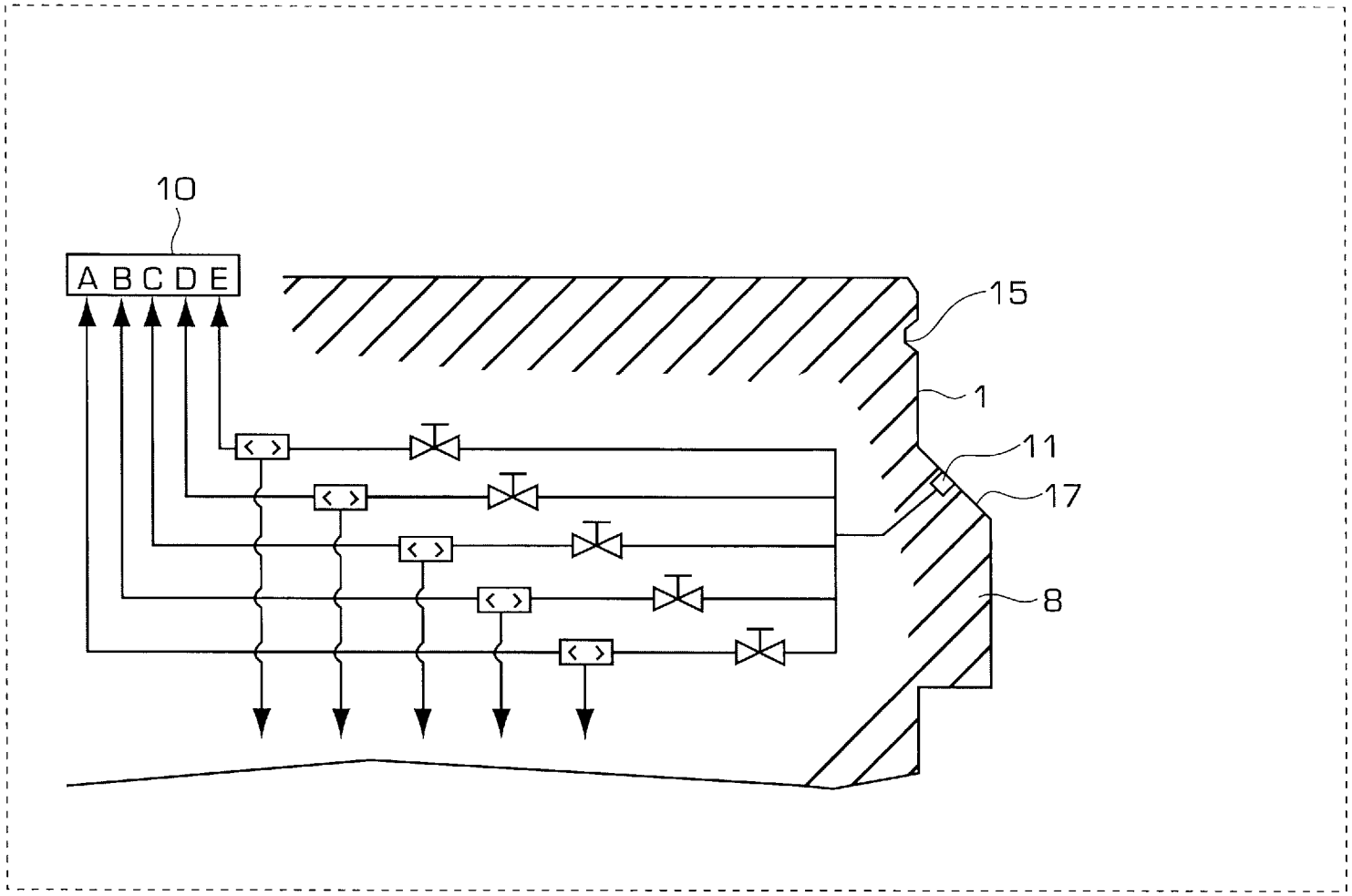
FIG. 5 is an illustrative view of the hydraulic scheme of shearing completion riser joint re-entry mandrel, according to the present invention.

Furthemore, as it can be seen from FIG. 5, we find illustrated the hydraulic scheme of the re-entry mandrel (8) of the shaearing completion riser joint (1), being shown the surface panel (10) and the unlocking function (11).

Figure 2A:
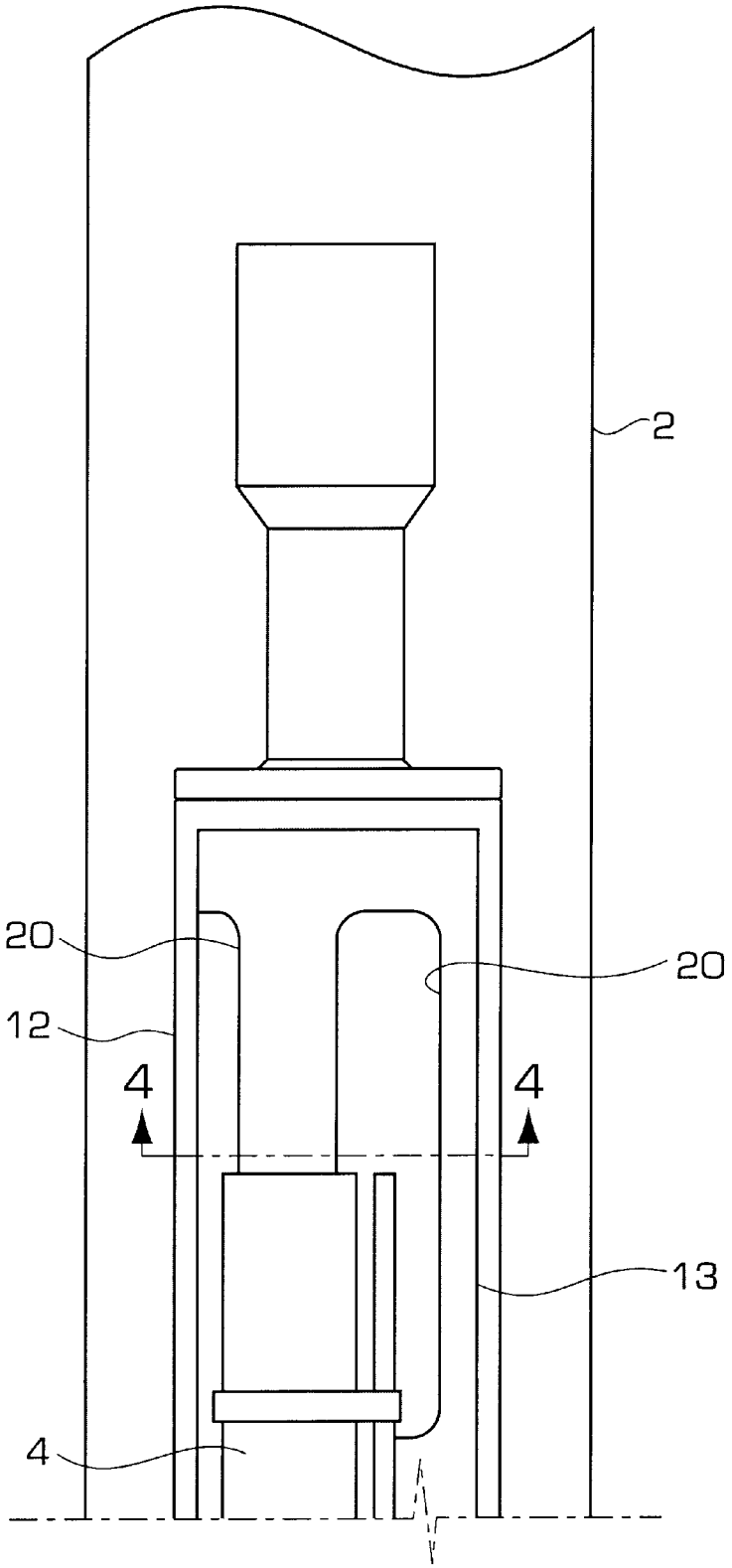
FIGS. 2A an 2B are sections representing the scheme of the recovery tool coupled to the shearing completion riser joint, after its cutting by the BOP.
Figure 2B:
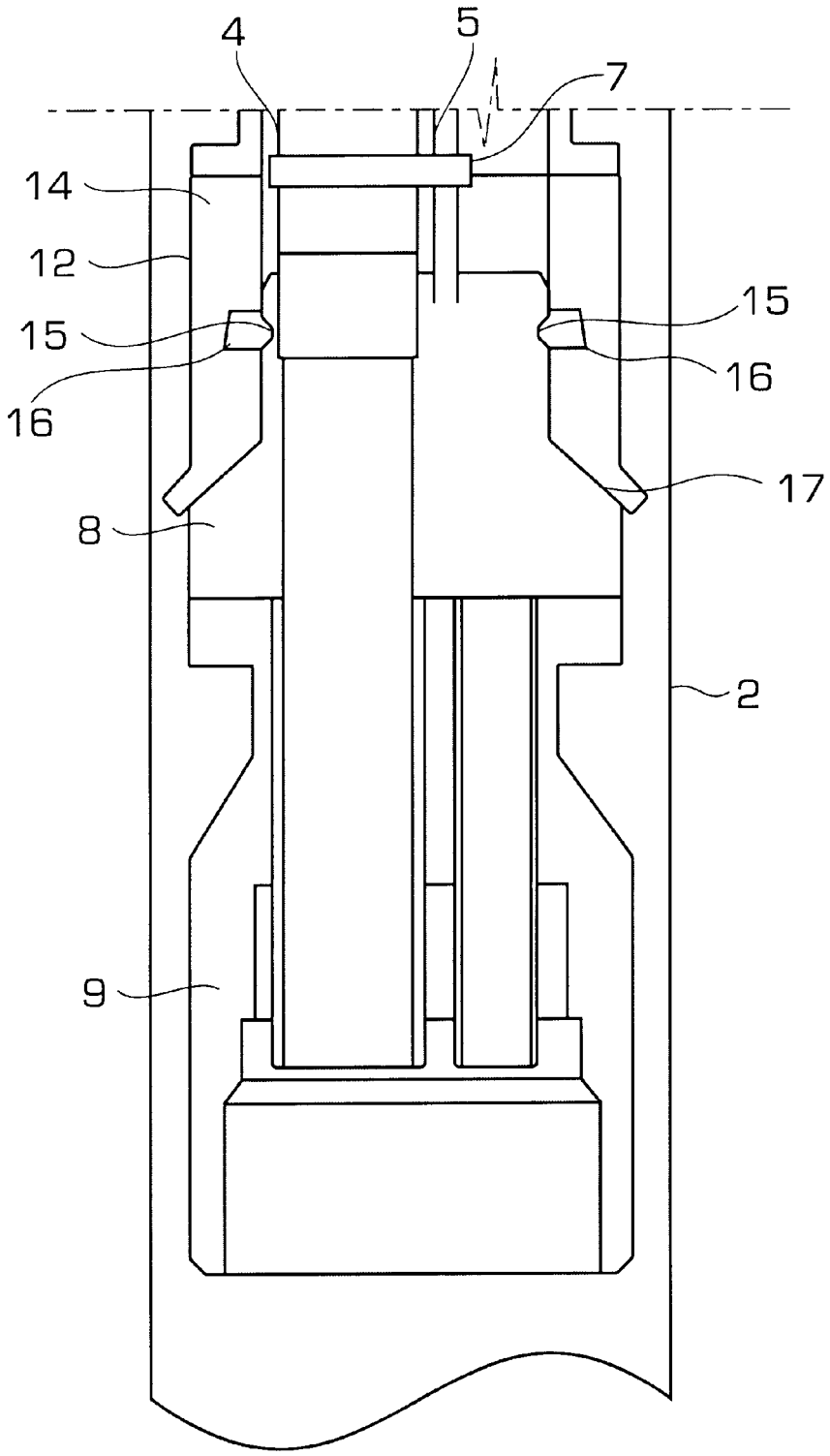
Figure 3:
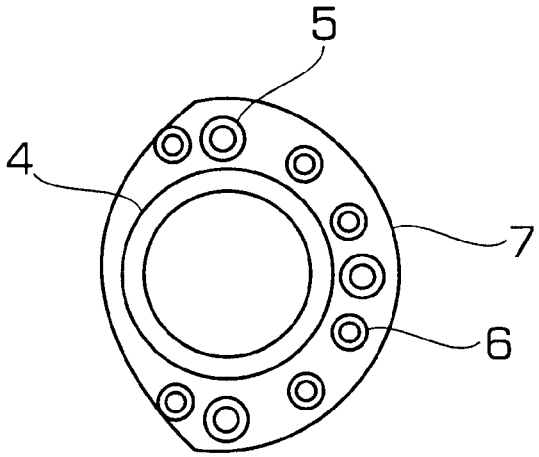
FIG. 3 represents an amplified cut taken along AA in the section of FIG. 1A.
Figure 4:
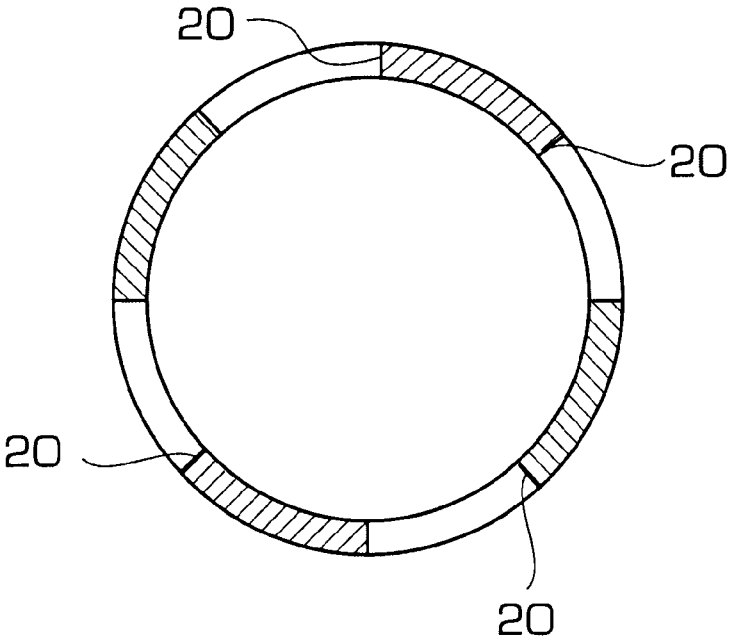
FIG. 4 represents an amplified cut taken along BB in the section of FIG. 2A.

Still according to the present invention, a tool (12) is provided to allow the release for removal the piping hoist running tool, after the cutting of the shearing joint (1) by the ram of the blow-out preventer (BOP) (2). As it can be seen from FIGS. 2A and 2B that show sections of the tool of recovery (12) scheme coupled to the shearing completion riser joint (1) and from FIG. 4 that represents a cut taken along BB in the section on FIG. 2A, the upper part comprises a fishing jacket (13) which function is to allow the jacketing of the sheared pipe (4) and, consequently, the access of the re-entry mandrel connector (8), referred fishing jacket (13) having tears to allow its cutting by the blow-out preventer (BOP) (2), in case of position loss during the fishing and the lower part comprises a hydraulic connector (14) that locks in the re-entry mandrel (8) and allows the access to the line of unlock of the column hoist running tool and its later removal.

We claim:

1. A shearable riser joint connectable at a lower end to a column hoist running tool and at an upper end to a riser column, said joint comprising a riser bolt disposed at said upper end of said joint for connection to said riser column, a re-entry mandrel disposed at said lower end and connected to a riser box which is connectable to a top end of the column hoist running tool and an access pipe connected to said riser bolt and said mandrel at opposite ends thereof, said access pipe being shearable by a shear ram of a blow-out preventer and including hydraulic lines having an external protector for connection to said column hoist running tool.

2. A shearable riser joint as set forth in claim 1, further comprising a recovery tool for use in releasing said column hoist running tool after shear cutting of said access pipe, said recovery tool being comprised of an upper portion including fishing jacket means for receiving a sheared pipe and a lower portion provided with hydraulic connecting means for connection to said mandrel to provide unlocking of the column hoist running tool prior to its subsequent removal.

3. A shearable riser joint as set forth in claim 2, wherein said fishing jacket means is comprised of a hollow cylindrical member having a plurality of apertures to facilitate cutting of the sleeve in the event of an emergency.

* * * * *